US005419474A

United States Patent [19]

Marx et al.

[11] Patent Number: 5,419,474

[45] Date of Patent: May 30, 1995

[54] HANDGUN HOLSTER WITH INTERNAL RETENTION DEVICE

[75] Inventors: Thomas A. Marx, Springfield, Mass.; Monte C. Salyards, Boise, Id.

[73] Assignee: Michaels of Oregon Co., Portland, Oreg.

[21] Appl. No.: 138,059

[22] Filed: Oct. 15, 1993

[51] Int. Cl.[6] ..... F41C 33/02

[52] U.S. Cl. ..... 224/244; 224/193; 224/911

[58] Field of Search ..... 224/192, 193, 242–245, 224/253, 911, 912

[56] References Cited

U.S. PATENT DOCUMENTS

| | | | |
|---|---|---|---|
| 1,113,530 | 10/1914 | Audley . | |
| 1,191,339 | 7/1916 | Noye | 224/245 X |
| 1,635,984 | 7/1927 | Corriston | 224/244 |
| 3,645,428 | 2/1972 | Angell | 224/244 |
| 4,256,243 | 3/1981 | Bianchi et al. | 224/244 |
| 4,277,007 | 7/1981 | Bianchi et al. | 224/193 |
| 4,298,150 | 11/1981 | Seldeen | 224/243 |
| 4,627,558 | 12/1986 | Bianchi et al. | 224/192 X |
| 4,846,384 | 7/1989 | Perry | 224/244 |
| 4,925,075 | 5/1990 | Rogers | 224/244 |
| 5,018,654 | 5/1991 | Rogers et al. | 224/244 |
| 5,094,376 | 3/1992 | Baruch | 224/243 |
| 5,100,036 | 3/1992 | Rogers et al. | 224/244 |
| 5,129,562 | 7/1992 | Bianchi | 224/244 |
| 5,282,559 | 2/1994 | Wisser et al. | 224/243 |
| 5,284,281 | 2/1994 | Nichols | 224/244 |

*Primary Examiner*—J. Casimer Jacyna

*Attorney, Agent, or Firm*—Chernoff, Vilhauer, McClung & Stenzel

[57] ABSTRACT

A handgun holster has a body that includes inner and outer sides. A catch projects into a handgun receiving pocket toward the inner side. The catch extends within and engages the trigger guard of a handgun carried in the pocket, preventing the handgun from being removed from the pocket. A part of the inner side or a resiliently movable structure associated with the inner side is moveable away from the end of the catch in response to outward pressure, to provide clearance for the trigger guard to pass by the catch so that the handgun can be removed from the holster only when the handgun is manipulated appropriately by the wearer. The catch includes a cam surface so that the trigger guard will slide past the catch when the handgun is placed into the holster.

19 Claims, 9 Drawing Sheets

HANDGUN HOLSTER WITH INTERNAL RETENTION DEVICE

BACKGROUND OF THE INVENTION

The present invention relates to a holster and more particularly to a handgun holster with an internal retention device for securely latching a handgun in the holster until its removal is desired by the holster wearer.

Handgun users, particularly those people engaged in law enforcement, require a holster in which a handgun remains securely held until being removed by the holster wearer. The holster must retain the handgun securely during not only the normal movements of the wearer, but also during more vigorous activity, possibly including physical contact such as action to restrain another person. While the holster should prevent unauthorized removal of the handgun, it should also permit rapid, safe and easy withdrawal of the handgun when its use is required by the holster wearer. Previous holster designs have compromised at least one of these objectives.

Devices intended to provide for maximum security of a handgun in a holster are generally of two types. In one type, an external security strap, such as one including a thumb break, is attached to the holster. In a second type, some form of internal security device is added to the holster. Most of such internal security devices are especially intended to prevent unauthorized removal of a handgun from the holster, as well as to prevent the handgun from falling out as a result of the wearer's activities.

Audley U.S. Pat. No. 1,113,530 discloses a leather holster having a spring-biased locking lug which engages the interior of the trigger guard of a handgun inserted into the holster. The lug is exposed to be pushed free from the trigger guard to permit removal of the handgun from the holster. Rogers U.S. Pat. No. 4,925,075 also discloses a holster having a spring-biased catch for engaging the trigger guard of a holstered handgun. The catch is shaped to allow the trigger guard to push it aside so that the handgun can be removed by moving it initially upward. These security devices do little to prevent the unauthorized removal of a holstered handgun from the holster by a person behind the wearer.

Baruch U.S. Pat. No. 5,094,376 discloses a holster in which pockets within the holster contain dowels which project into an ejection port and the trigger guard of a pistol. The pistol is released by a rearward motion including an outwardly twisting movement of the pistol butt away from the wearer's body. Thus, removal of the pistol is not particularly easy, but pulling the pistol butt away from a wearer, as might be expected of someone other than the holster wearer trying to take the pistol, can help release the pistol.

Bianchi et al. U.S. Pat. Nos. 4,256,243 and 4,277,007 disclose a holster having a spring-biased finger which projects into the area surrounded by the trigger guard of a handgun in the holster, but the finger is moved aside by the trigger guard during normal withdrawal of the handgun. Perry U.S. Pat. No. 4,846,384 discloses a top-opening holster which includes a restraining wedge that projects into the trigger guard of a holstered handgun, but which is moved aside by the trigger guard as the handgun is rotated forward during withdrawal from the holster. Rogers et al. U.S. Pat. No. 5,018,654 discloses a holster having a restraining device including bosses to engage the trigger guard, but which also are moved aside as the handgun is rotated forward during withdrawal. None of these retention devices would prevent a holstered handgun from being removed vertically upward or from the front of the holster wearer by another person. In addition, these holsters do not permit a handgun to be drawn with a simple, natural movement by the holster wearer, since the handgun must first be rocked forward to release it from the restraint.

Thus, none of the known prior handgun holsters is satisfactorily able to prevent unauthorized removal of a holstered handgun. In addition, none of such previously known holsters including internal handgun restraints permits easy and safe unholstering of the handgun while also permitting the holster wearer to keep hand and wrist in a natural, locked, shooting position, beginning with initial hand placement on the handgun and continuing through removal of the handgun from the holster to presentation on target.

What is still needed is a holster having an internally located retention device which permits a holstered handgun to be withdrawn in a natural motion by the holster wearer, but which also effectively prevents unauthorized withdrawal of a handgun from the holster by another person.

SUMMARY OF THE INVENTION

The present invention overcomes the aforementioned problems associated with previously available holsters by providing a handgun holster with an internal retention device which prevents the handgun from being removed from the holster until after a slight rotation of the gun about an axis generally parallel with the barrel of the handgun. A holster according to the invention has a body which includes outer and inner sides which are interconnected, possibly by a welt or similar interconnecting structure, to define the rear portion of an upwardly open or openable pocket for receiving a handgun including a trigger guard. A catch is attached to the outer side and projects within the pocket toward the inner side, the side closer to the holster wearer's body. The catch is located where it will be engaged with the trigger guard when the handgun is fully holstered and is configured and mounted so that attempting simply to pull the handgun directly from the holster does not allow the trigger guard to pass the catch. The sides have a normal position with respect to each other in which the inner side is close enough to the outer side to keep the trigger guard engaged with the catch, securing the handgun within the holster. A part of the inner side, or a movable structure associated with the inner side, however, is movable away from the end of the catch to provide clearance, at least as great as the lateral width of the trigger guard, for passage of the trigger guard past the catch to remove the handgun from the holster.

Thus, when a handgun is inserted into the holster, the inner side or associated movable structure is forced temporarily away from the end of the catch as the trigger guard moves past the end of the catch, and the trigger guard moves to extend around the catch as the handgun is seated in the holster.

In a preferred embodiment of the invention the catch is located proximate the structure interconnecting portions of the inner and outer sides, but is spaced apart from the interconnecting structure by a distance at least equal to the radial thickness of the trigger guard.

In one embodiment of the present invention, the body of the holster is constructed from a resilient, laminated sheet material that includes a flexible and resiliently compressible layer. Pressure is directed inwardly of the pocket of the holster against a handgun in the pocket by the compressible layer of the holster body, which helps to urge the handgun into its normal secured position in which the trigger guard is engaged by the catch, and helps to maintain the inner and outer sides of the holster body in their normal positions relative to each other.

In a preferred embodiment of the invention the body of the holster also includes a frame of resiliently stiff sheet material supporting the resilient, laminated sheet material of the inner and outer sides, and also includes a spacer for providing clearance, between the inner side and the holster wearer for movement of a part of the inner side or the associated movable structure.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 2:
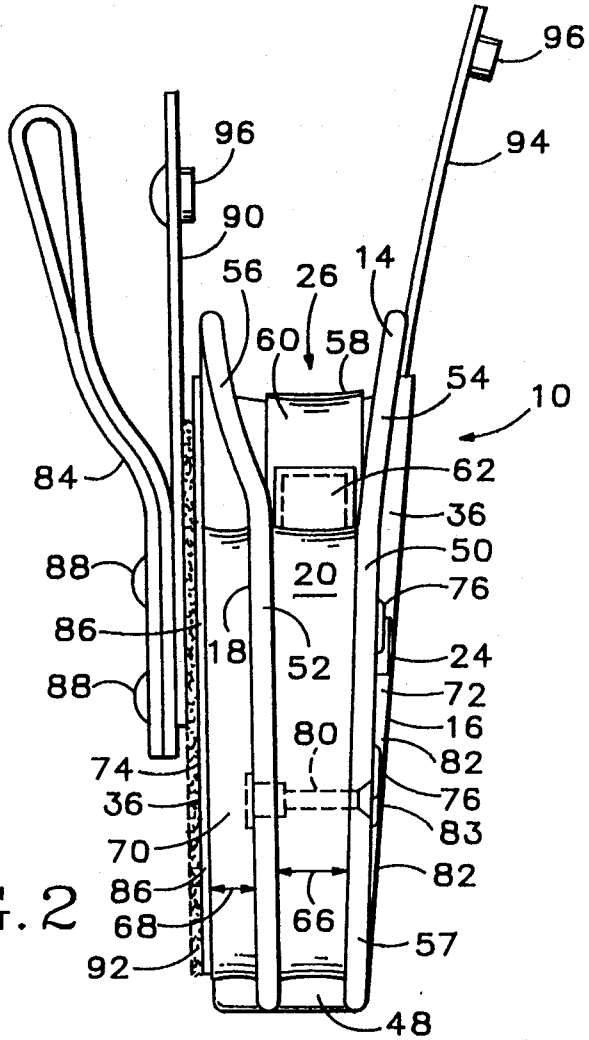
FIG. 2 is a rear elevational view of the holster shown in FIG. 1, without the handgun.
Figure 1:
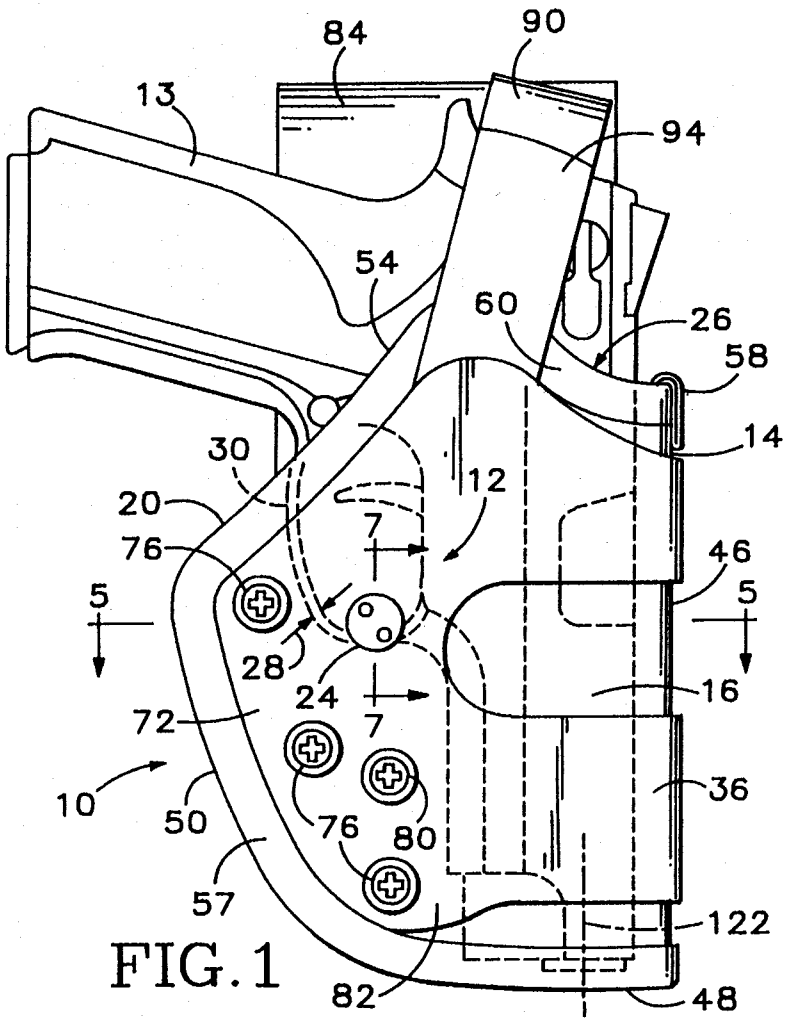
FIG. 1 is an outer side elevational view of a holster embodying the present invention, showing a handgun held in the holster.

Referring now to the drawings, FIGS. 1-7 show a holster 10 embodying the present invention. An internal retention device 12 is included in the holster 10 for holding a handgun 13 securely in the holster and preventing undesired withdrawal. A body 14 of the holster includes an outer side 16 and an inner side 18 interconnected by a connecting portion such as a welt 20 located between the respective rear margins 50 and 52 of the outer side 16 and inner side 18. A catch 21, including a screw 24, is associated with the outer side 16 of the holster body 14, where it projects into a handgun-receiving pocket 26 of the holster and extends toward the inner side 18. The catch 21 is spaced apart from the welt 20 by a distance at least equal to the radial thickness 28 of the trigger guard 30 of the handgun 13, leaving room for the trigger guard 30 to rest between the catch 21 and an inner surface 64 of the welt 20. Although the screw 24 extends through the outer side 16 it is not critical that the catch 21 be attached by extending through the outer side 16; however, the catch 21 must be associated with the outer side 16 and protrude toward the inner side 18. Thus, the catch 21 could be attached to the inner surface of the outer side 16 within the pocket 26 or be supported by the welt 20 as will be explained in more detail presently.

A part 123 of the inner side 18 of the body 14 is movable away from the end 32 of the catch 21 to provide a clearance at least as great as the lateral width 34 of the trigger guard 30, to allow passage of the trigger guard 30 past the catch 21, as will be discussed below in more detail.

Figure 4:
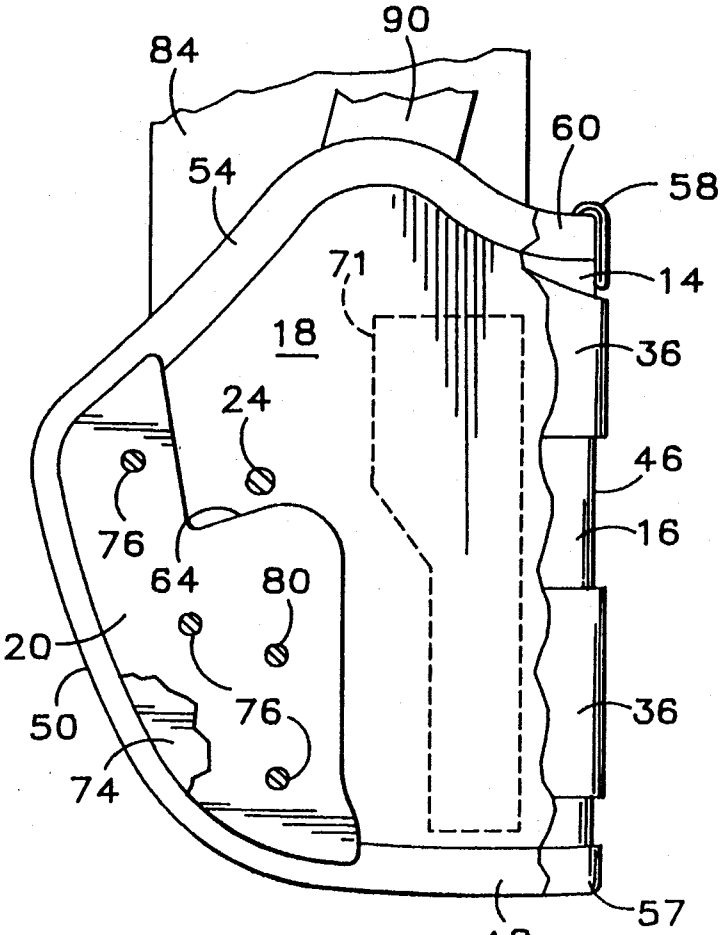
FIG. 4 is a partially cut-away outer side elevational view of part of the holster shown in FIG. 1, without the handgun.
Figure 3:
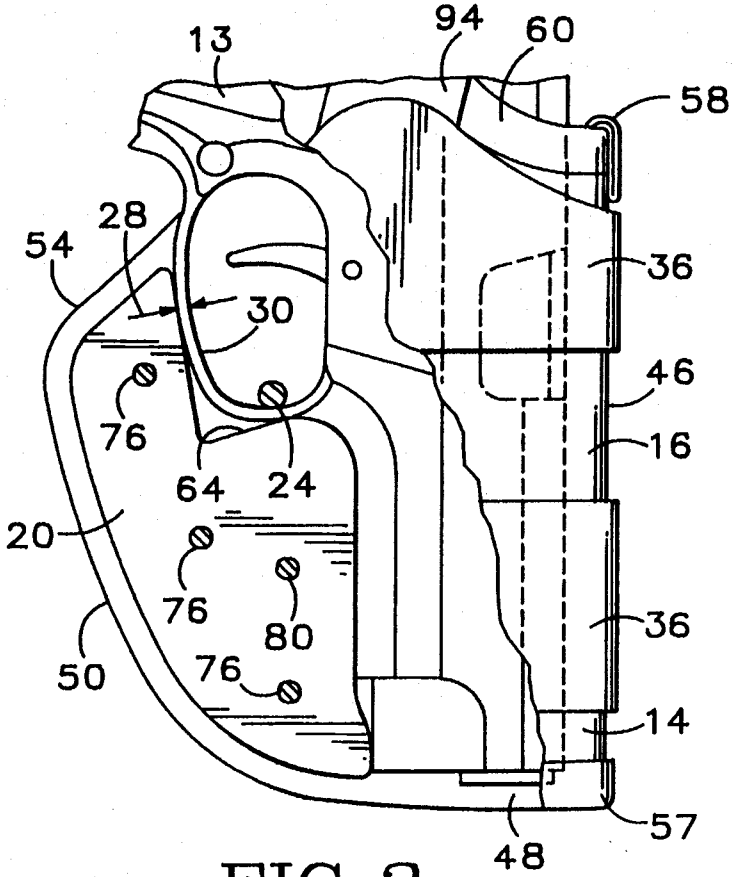
FIG. 3 is a partially cut-away outer side elevational view of part of the holster and handgun shown in FIG. 1.

The holster body 14 includes a frame 36 surrounding and supporting the outer side 16 and inner side 18. The frame 36 is a thin sheet of a suitably stiff, resilient, tough, and yet somewhat flexible material (such as a copolymeric mixture of polyvinylchloride and polyacrylic plastic material available from Kleerdex Company of Mt. Laurel, N.J., under the trademark "Kydex"), which is cut to the desired shape. The frame 36 is attached to the inner side 18 of the body 14 in this embodiment of the invention as by being sewn to it by a seam 71 of stitches spaced apart from the rear margin 52, as shown in FIG. 4, to leave the part 123 of the inner side 18 free to move as will be explained further below.

Figure 6:
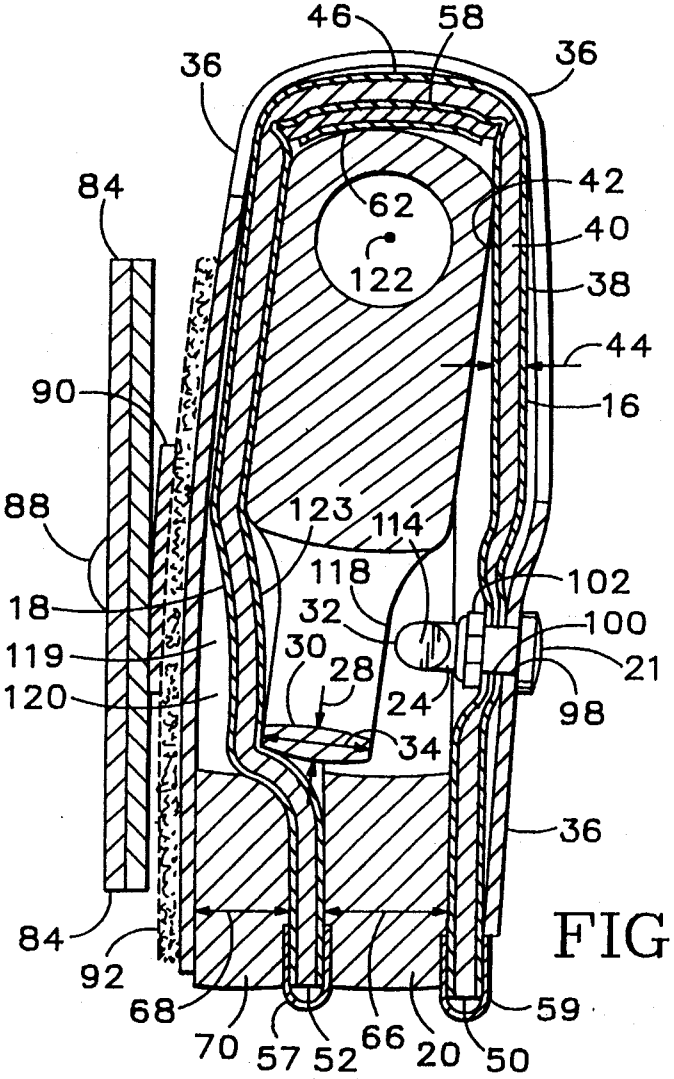
FIG. 6 is a sectional view similar to FIG. 5, but showing the handgun positioned ready to be withdrawn.
Figure 5:
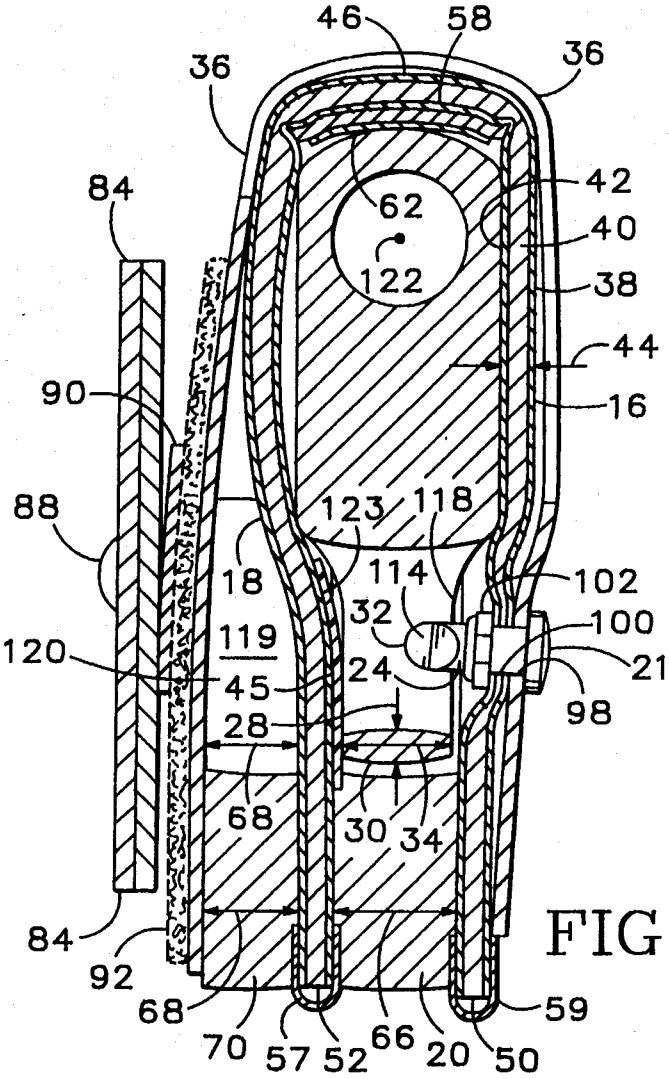
FIG. 5 is a sectional view of the holster and handgun shown in FIG. 1, taken along line 5—5.

As best shown in FIGS. 5 and 6, in the embodiment of the invention shown, the outer side 16 and inner side 18 are constructed of a multi-layered, resilient, laminated sheet material, including an outer layer 38, an intermediate layer 40, and an inner layer 42. The outer layer 38 is a sturdy, wear-resistant, strong material such as a 1000-denier woven nylon cloth, and the inner layer 42 is preferably a softer, non-abrasive material such as a 430-denier smooth-surfaced nylon pack cloth, although the layers 38 and 42 might be of other materials, including leather. The intermediate layer 40 is a compressible resilient material, for example, a synthetic polymeric foam such as an open-cell polyethylene foam having a density of 9–15 pounds per cubic foot and having a thickness 44 of about ¼ inch when relaxed. Other resilient materials such as closed cell foam could also be used, the principally desired requirement being that the material should help the part 123 of the inner side 18 return to and remain in a normal position close enough to the catch 21 to engage the trigger guard 30 to keep the handgun 13 in the pocket 26 of the holster 10. Preferably, a thin layer 45 of a polyurethane overlies the part 123 of the inner side 18 located opposite the catch 21, to protect that part,of the inner layer 42 from wear. As a variation (not shown), an additional resiliently flexible piece such as a spring may be used to help restore the part 123 of the inner side 18 to its normal location.

The outer layer 38, intermediate layer 40, and inner layer 42 are interconnected by thermal welding or adhesives (not shown). The laminated material is bent to form roughly a "U" shape as seen from above the holster 10, defining a front 46, a bottom 48, the outer side 16, the inner side 18, and their respective rear margins 50 and 52, and generally diagonal respective upper margins 54 and 56. A binding 57, which is a thin yet strong fabric, such as a nylon sateen ribbon about 1 inch wide, extends around and protectively covers the margins of the laminated material.

Although such a construction is not shown, it is also contemplated that a structure similar to the frame 36 could be incorporated between layers of the laminated material, instead of extending about the outside of the laminated material. For example, such a structure could be located between a pair of thinner layers of compressible, resilient foam material replacing the intermediate layer 40.

A spine 58, which is a tape of woven nylon webbing approximately one inch wide, extends along the interior of the front 46 of the pocket 26, where it is securely attached by a layer of adhesive (not shown) and by sewing at the top 60 of the pocket 26, where the tape overlies the margin of the pocket 26, and at the bottom 48 of the pocket 26. A flat strip 62 of a thin, relatively soft sheet material such as a soft polyurethane, about ¾ inch wide and 0.02 inch thick, is securely sewn to the spine 58 along the margins of the strip 62, as shown best in FIGS. 2, 5 and 6.

The welt 20 is located between and connects the respective rear margins 50, 52 of the outer side 16 and inner side 18. The inner surface 64 of the welt 20, preferably having a contour generally corresponding to the shape of a part of the handgun 13, is part of the interior surface of the pocket 26, as best shown in FIGS. 3–6. The welt 20 has a thickness 66 of, for example, one-half inch, which is at least equal to, and preferably slightly greater than, the lateral width 34 of the trigger guard. The thickness 66 thus may vary depending upon the handgun for which a particular holster is intended.

As shown in FIGS. 2, 5, and 6, a spacer 70 similar to a welt is located between the frame 36 and the rear margin 52 of the inner side 18. The spacer 70, as shown, has a surface 119 preferably similar in shape to the shape of the surface 64 of the connecting welt 20, so as not to obstruct movement away from the outer side 16 by the part 123 of the inner side 18 opposite the catch 21. The welt 20 and spacer 70 may be made of a firm, rubber-like material such as a microporous synthetic foam rubber, or may be of a molded tough and resilient, but stiff, plastic.

As shown in FIGS. 1–4, the rear margins 72, 74 of the frame 36 are interconnected by fasteners such as bolts 76 which extend through respective bores defined in the corresponding portions of the frame 36, the outer side 16, the connecting welt 20, the inner side 18, and the spacer 70.

An adjustable fastener such as a clamp bolt 80 extends through an area 83 of the outer side portion 82 of the frame 36 and through corresponding portions of the outer side 16, the connecting welt 20, and the inner side 18 of the body 14, without extending through the spacer 70 and the inner side portion 86 of the frame 36. The adjustable fastener permits adjustment of the holster 10 to receive a particular handgun snugly, by adjusting the spacing between portions of the sides 16 and 18 and adjusting the degree to which the frame 36, and particularly its lower horizontal band, compresses the inner side 18 and outer side 16, especially the intermediate layer 40 of each, against the handgun.

A belt loop 84 is attached to the inner side portion 86 of the frame 36 by fasteners such as socket-headed cap screws and mating T-nuts 88. A thumb break 90 is attached adjustably to the inner side portion 86 of the frame 36 by means of suitably located hook-and-loop fastener material 92. A security strap 94 is attached to the outer side 16 of the body and may be secured detachably to the thumb break 90 by a fastener such as a snap 96 to hold the handgun 13 securely in the holster 10 when need to use the handgun 13 is not imminent. It is to be understood, however, that the retention device of the present invention still provides security for the handgun 13 when the thumb break 90 and security strap 94 are separated.

Figure 8:
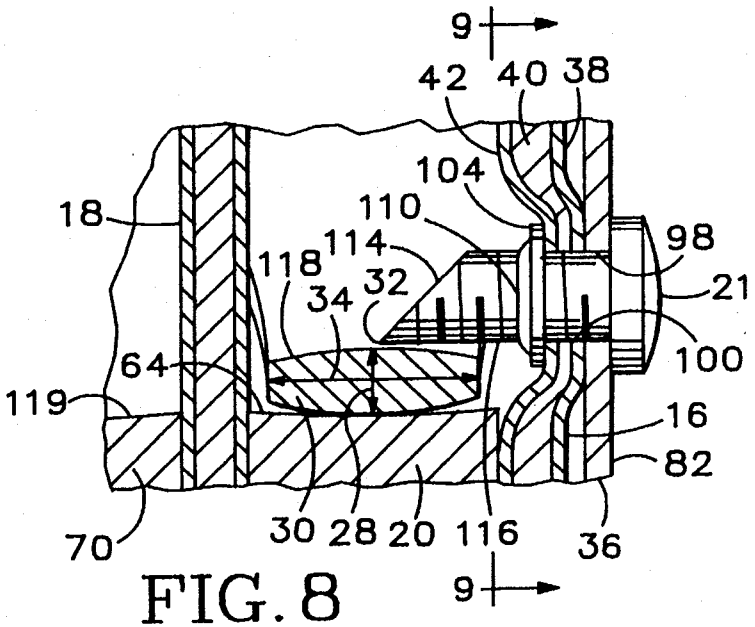
FIG. 8 is a sectional view similar to FIG. 7, showing a portion of a holster including a slightly different embodiment of the retention device shown in FIG. 7.
Figure 7:
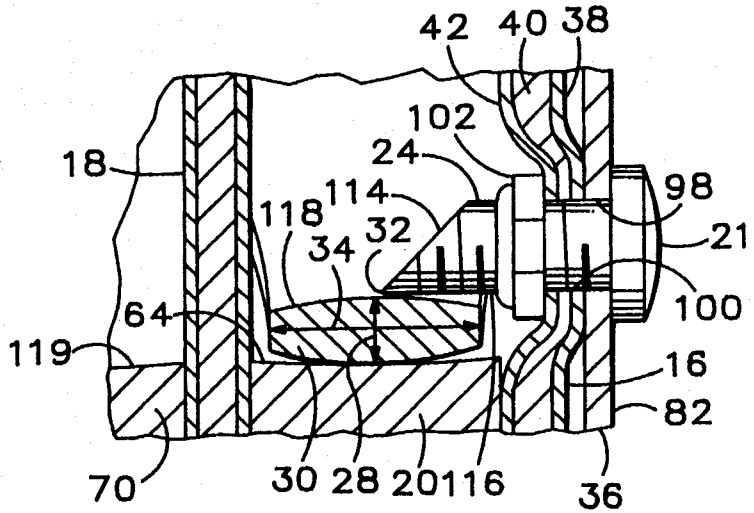
FIG. 7 is a sectional view of a detail of the holster shown in FIG. 1, taken along line 7—7 at an enlarged scale.

As best shown in FIGS. 7 and 8, the screw 24 of the catch 21 passes through a hole 98 in the outer side portion 82 of the frame 36 and through a hole 100 in a corresponding location in the layers 38, 40, and 42 of the outer side 16. The screw 24 is fastened securely in the desired location by means of a nut 102 pressing against the inner layer 42 of the outer side 16. The end 32 of the screw 24 is thus spaced apart from the inner side 18 by a distance which is less than the lateral width 34 of the trigger guard 30 when the inner side 18 is in its normal position relative to the outer side 16. Where a holster does not include structure such as the frame 36 a catch 21 could be fastened directly to the material of the outer side 16,.With support provided as necessary to hold the catch 21 securely in place so that it cannot simply be moved to allow the trigger guard 30 to be disengaged from it.

Figure 9:
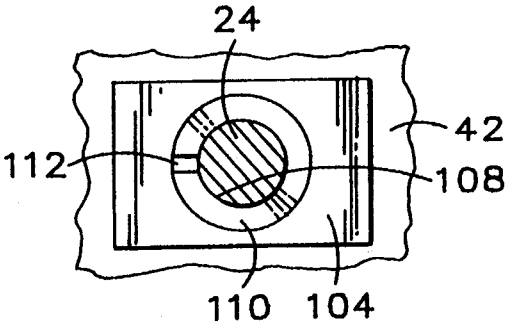
FIG. 9 is a sectional view of the portion of a holster shown in FIG. 8, taken along line 9—9.

In an alternative embodiment of the catch 21 (FIGS. 8, 9), a fastener such as a self-threading nut 104 is mated with the screw 24 and is located to press against the layer 42 of the outer side 16. The self-threading nut 104 is a thin, spring steel plate including a helical collar 110 defining a hole 108 and including a notch 112 to mate with a thread of a screw or bolt.

As best shown in FIGS. 5–8, the catch 21 includes an oblique cam surface 114 of the screw 24 sloping downward toward the inner side 18, and the other surfaces of the screw 24 are aligned generally transversely within the holster pocket 26 (although the surfaces may define an external helical thread). The screw 24 thus includes a transversely oriented bottom side 116. In order to help avoid unintentional movement of the screw 24, a special tool is preferably required to turn the screw 24.

As the handgun 13 is inserted downward into the holster 10, the trigger guard 30 encounters the cam surface 114, which guides the trigger guard 30 against the inner side 18 and past the end 32 of the screw 24, while the inner side 18 continually urges the handgun 13, including the trigger guard 30, toward the outer side 16. The downward movement of the handgun 13 into the pocket 26 ceases when the trigger guard 30 encounters the inner surface 64 of the connecting welt 20. Depending on the location of the screw 24 and the radial thickness 28 of the trigger guard 30, the bottom surface 116 of the screw 24 engages the inner surface 118 of the trigger guard 30, or is located inside the trigger guard 30 a small distance apart from the inner surface 118, thus securing the handgun 13 in the holster 10. The handgun 13 may thus be inserted readily and easily into such a latched position, where it is urged to remain by the resilient sides 16 and 18.

At the same time, the screw 24 is close enough to the inner surface 64 of the welt 20 that the inner surface 64 stops the handgun from moving far enough into the pocket 26 to bring the trigger of the handgun 13 into contact with the catch 21. Thus, the catch 21 cannot cause the handgun 13 to fire.

Preferably, the shape and location of the upper surface 119 of the spacer 70 are similar to those of the inner surface 64, so that when the handgun 13 is rotated to a position in which the trigger guard 30 can pass downward past the catch 21, the handgun 13 is still prevented from being moved far enough into the pocket 26 for the catch 21 to contact the trigger.

To remove the handgun 13 from the holster 10 the handgun 13 is manipulated to move the trigger guard 30 toward the inner side 18 far enough to displace the part 123 of the inner side 18 away from the catch 21 and thus create sufficient clearance for the trigger guard 30 to pass between the inner side 18 and the end 32 of the catch 21. This manipulation is easily accomplished by gripping the butt of the handgun 13 and pressing it inward, toward the wearer's body, thus causing a slight rotation of the handgun 13, through an angle of no more than a few degrees, about an axis of rotation 122 generally parallel with, or even coincident with, the bore of the barrel of the handgun 13. As best shown in FIGS. 5 and 6, the spacer 70 has a width or thickness 68 sufficient to maintain a space 120 between the inner side 18 and the frame 36. The part 123 of the inner side 18, when forced aside by the trigger guard 30, moves into the space 120 and away from the end of the catch 21 to 30 provide clearance, at least as great as the lateral width 34 of the trigger guard, between the inner side 18 and the end 32 of the screw 24.

Once such clearance is available, while the handgun 13 is kept in such a slightly rotated position, it can be withdrawn upwardly from the pocket 26. During such withdrawal the trigger guard moves past the catch 21 in the first few millimeters of upward movement so that the remainder of the motion of drawing the handgun 13 from the holster 10 is identical to drawing such a handgun from a holster lacking the retention device of the invention. The slight inward rotation required to disengage the trigger guard 30 from the catch 21, moreover, encourages the movement of the arm closer to the holster wearer's body, promoting a better posture for drawing and which is more likely to result in accurate aiming of the handgun 13.

The restorative forces in the inner side 18, provided in part by the flexible and compressible intermediate layer 40 in the holster 10 disclosed herein, restore the inner side 18, including part 123 thereof, to its normal unflexed position with respect to the outer side 16 when the trigger guard 30 is no longer being forced toward the inner side 18. Thus, while the handgun 13 can be quickly and easily removed from the holster 10 by the wearer, the retention device of the invention effectively secures the handgun 13 to prevent accidental loss or theft of the handgun 13 from the holster 10.

The handgun 13 cannot be withdrawn from the holster 10 simply by raising the handgun vertically, because the catch 21 engages the trigger guard 30. Similarly, grasping the handgun 13 and pulling forward, as if a person in a position in front of the person wearing the holster 10 is attempting to remove the handgun, or attempting to remove the handgun 13 by pulling outwardly away from the side of the person wearing the holster 10, will result in the catch 21 continuing to engage the trigger guard 30. Even such an attempt by a person standing behind a person wearing the holster 10 will be unsuccessful because it would not ordinarily include the inward rotation of the handgun 13 required to release it from the holster 10.

Figure 11:
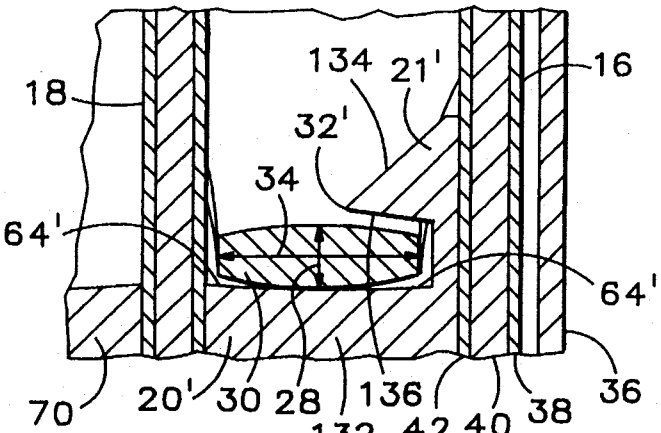
FIG. 11 is a sectional view of the holster shown in FIG. 10 taken along line 11—11.
Figure 10:
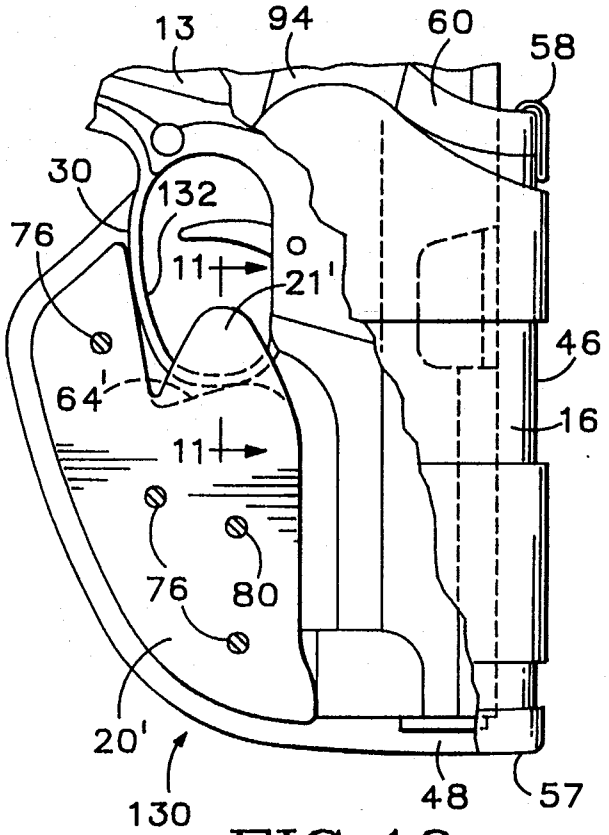
FIG. 10 is a partially cut-away outer side elevational view of part of a holster which is an alternative embodiment of the present invention, with a handgun located in the holster.
Figure 17:
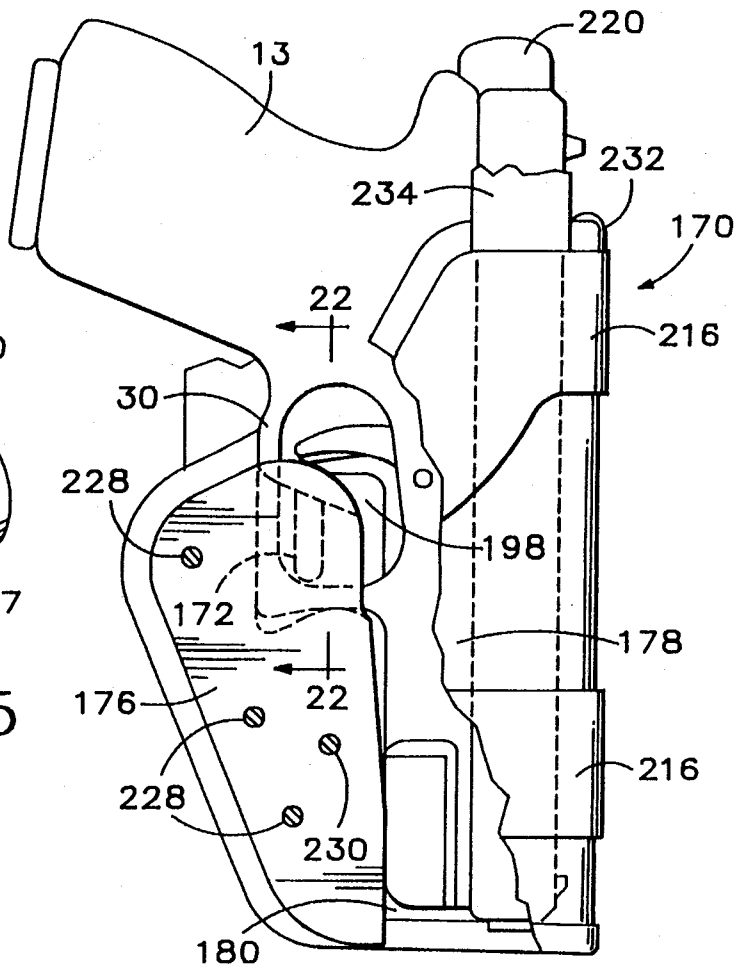
FIG. 17 is a partially cut-away outer side elevation view of a holster, together with a handgun held in the holster by an internal retention device which is another embodiment of the present invention.

A holster 130, which is an alternative embodiment of the invention, is shown in FIGS. 10 and 11. Except as will be described presently, the holster 130 is similar to the holster 10 and like reference numerals refer to like structures. A catch 21' is an integral part of a connecting portion 132 interconnecting the rear portions of the inner side 18 and outer side 16. As shown in FIGS. 10 and 11, the catch 21' is integral with a welt 20' and projects into the holster pocket 26 toward the inner side 18 of the body 14. The welt 20' includes an inner surface 64' similar to the surface 64 of the welt 20.

The connecting portion 132 including the welt 20' and the catch 21' may be molded of a suitably strong and hard material, such as a thermoplastic synthetic polymeric material which is soft enough not to damage the finish of the handgun 13 which is to be carried in the holster 10', yet which is wear-resistant and stiff enough to withstand having the trigger guard 30 pushed against it, and to hold the handgun securely in the holster 130. The catch 21' includes an upwardly facing, obliquely inclined cam surface 134 corresponding to the cam surface 114 of the screw 24 to urge the trigger guard 30 against the part 123 of the inner side 18 during placement of the handgun 13 into the holster 10. A bottom surface 136 is oriented transversely of the holster body 14 and is shaped to conform generally to and to engage the interior surface 118 of the trigger guard 30 and thus to counteract attempts to pull the handgun 13 from the holster 130 in an upward, laterally outward, rearward, or forward, direction. As with the catch 21 of the holster 10, removal of the handgun 13 from the holster 130 requires that the handgun 13 be manipulated to move the trigger guard 30 clear of the catch 21' by displacing the part 123 of the inner side 18 far enough to provide clearance for the trigger guard 30 between the inner side 18 and the end 32' of the catch 21'.

Figure 13:
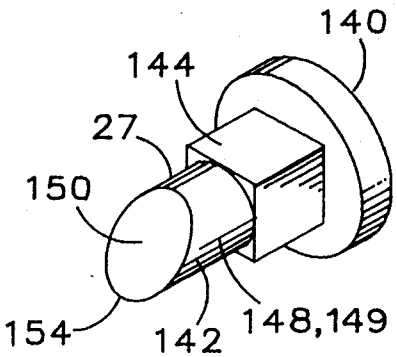
FIG. 13 is a perspective view of a pin which is part of the retention device shown in FIG. 12.
Figure 12:
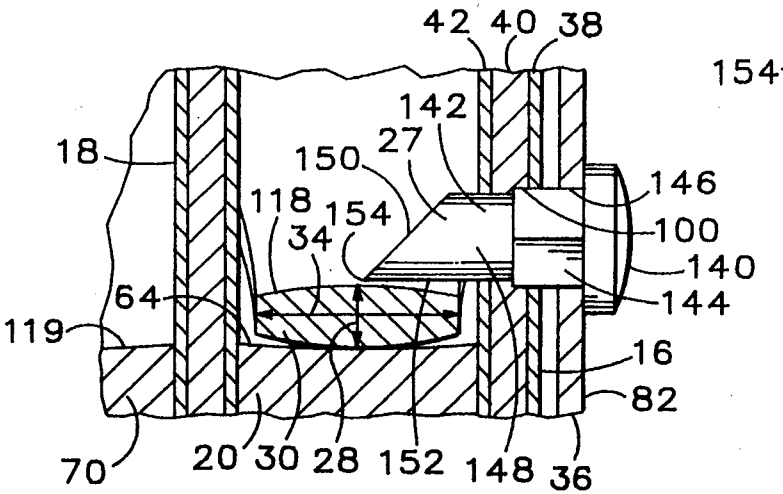
FIG. 12 is a view similar to FIG. 7 showing a different embodiment of the invention.

A pin 27 which is an alternative part of the structure of the catch 21, is shown in FIGS. 12 and 13 together with a portion of a holster incorporating the retention device of the invention. Except as described below, the pin 27 is similar to the screw 24 and like reference numerals refer to like structures. The pin 27 has a head 140 attached to a shank 142. The shank 142 has a square portion 144 which fits tightly in a square hole 146 in the frame 36 to prevent rotation of the pin 27. The pin 27 may be further secured in place by ultrasonic welding or by adhesively attaching the pin 27 to the frame 36, for example. Extending from the square portion 144 of the shank 142 is a cylindrical portion 148, which includes a rear surface 149 and an oblique cam surface 150 corresponding to the surface 114 of the screw 24, a transversely oriented bottom surface 152, corresponding to the surface 116 of the screw 24, and an end 154, corresponding to the end 32 of the screw 24.

Figure 15:
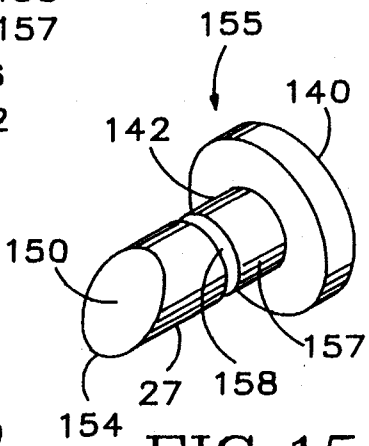
FIG. 15 is a perspective view of a pin which is part of the retention device shown in FIG. 12.
Figure 14:
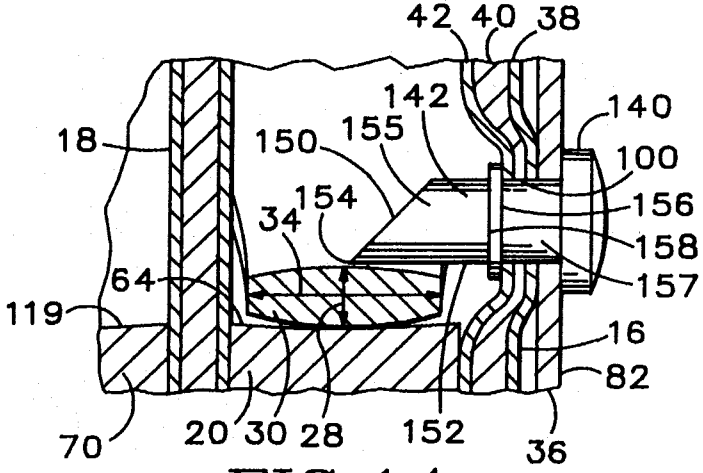
FIG. 14 is a view similar to FIG. 7 showing another different embodiment of the invention.

A slightly different structure includes a pin 155, shown in FIGS. 14 and 15, which is similar to the pin 27 except as described below, and like reference numerals refer to like structures. A fastener such as a snap ring 156 is seated in a groove 158 located on the cylindrical shank 157 of the pin 155 to press against the layer 42 of the outer side 16. A similar groove and fastener might also be located on the cylindrical portion of the shank of a pin which includes a square portion, such as the pin 27 shown in FIGS. 12 and 13.

Figure 16:
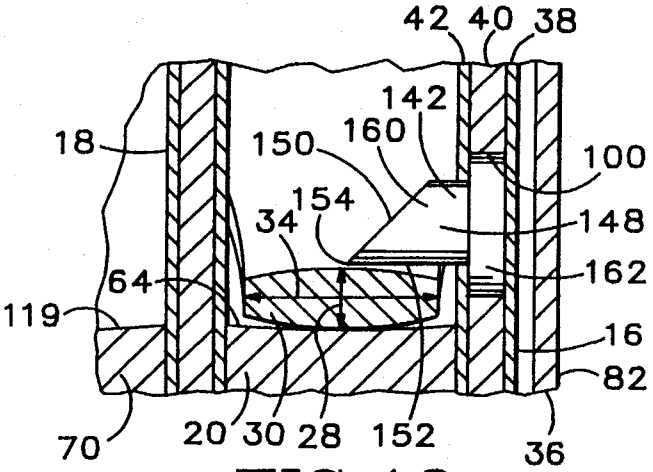
FIG. 16 is a view similar to FIG. 7 showing a further different embodiment of the invention.
Figure 20:
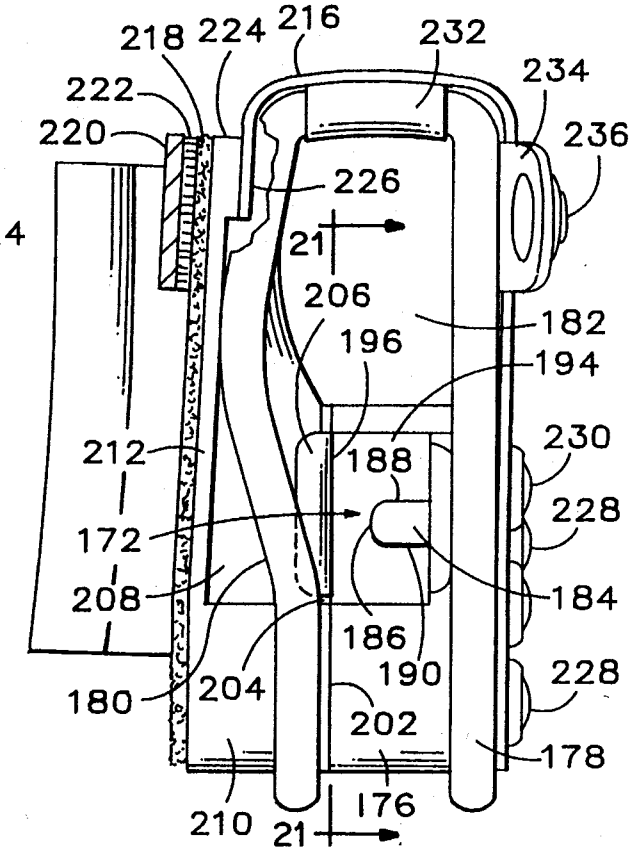
FIG. 20 is a top plan view of the holster shown in FIGS. 17-19.
Figure 19:
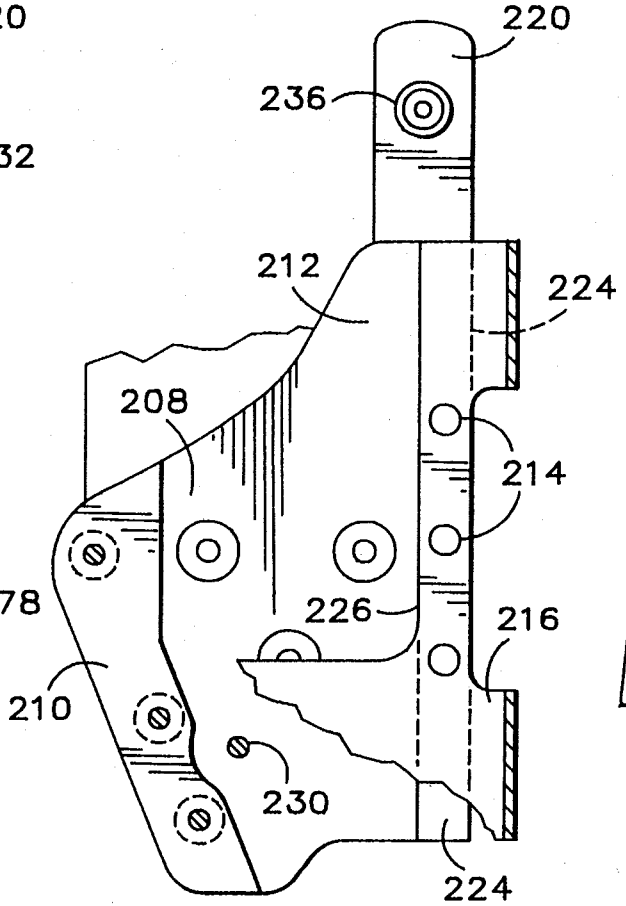
FIG. 19 is an outer side view of the holster shown in FIGS. 17 and 18, but with the laminated fabric portions of the handgun-receiving pocket and portions of the outer frame of the holster omitted to expose the backing plate of the holster.
Figure 18:
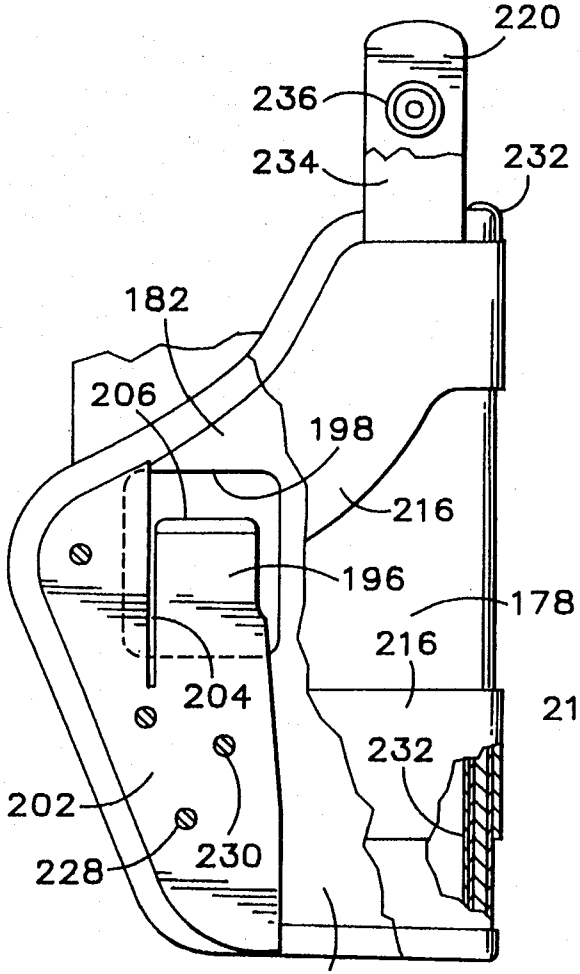
FIG. 18 is a view similar to that of FIG. 17, with additional elements cut away, and without the handgun in the holster.
Figure 22:
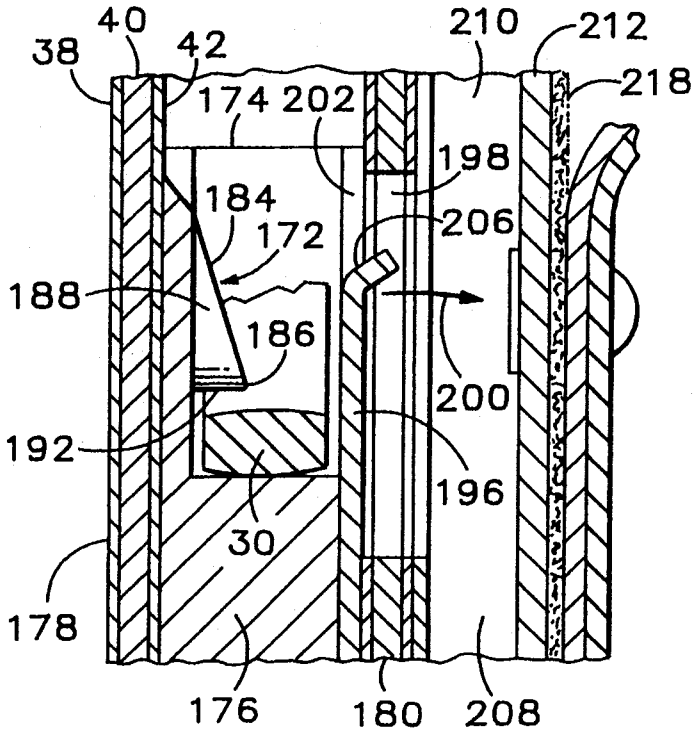
FIG. 22 is a sectional view of a detail of the holster shown in FIG. 17, taken in the direction indicated by the line 22—22.
Figure 21:
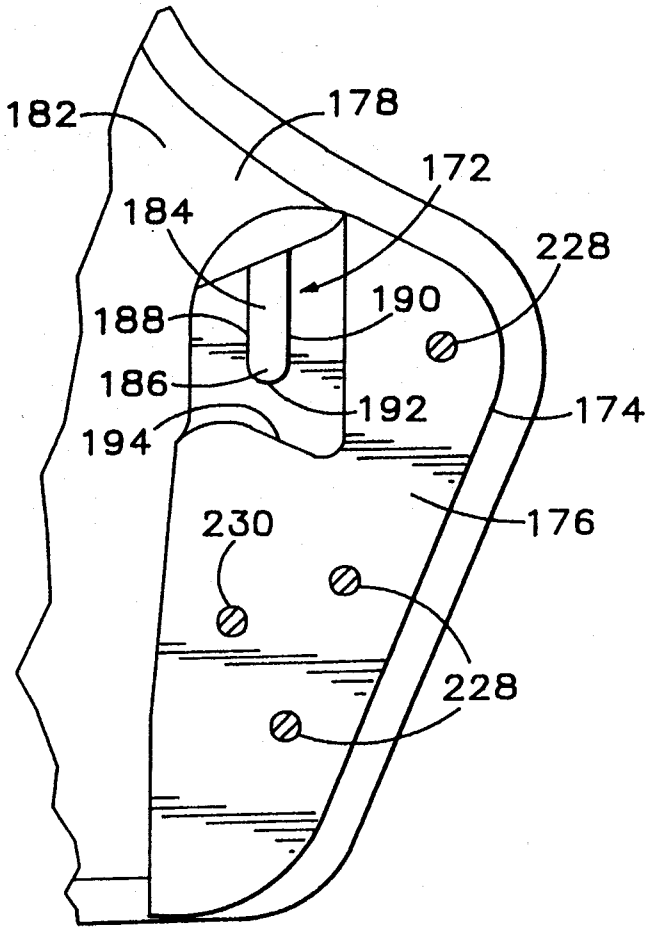
FIG. 21 is a sectional detail view of the holster shown in FIG. 17 taken in the direction of line 21—21 of FIG. 20 and showing the catch used to retain a handgun within the holster.

As shown in FIG. 16, a pin 160, which is similar to pins 27 and 155 except as described below, may be somewhat shorter than the pins 27 and 155. The pin 160 has a head 162 located between the layers of the holster body, such as between the layers 42 and 38, and surrounded by layer 40, as shown in FIG. 16. Such a location may be particularly desirable where a stiffener (not shown) is also included in the holster body or where the layers 42 and 38 themselves are composed of a somewhat rigid material such as leather or a synthetic or polymeric material more rigid than the cloth and foam described above as the outer side 16 of the holster body 14.

A holster embodying the present invention might also include a body constructed of leather or molded or shaped materials such as synthetic plastic sheet material molded to an appropriate shape. Such a holster could be of a break front or semi-break front design or be a holster of more conventional design. The interior volume of such a holster would permit rotation of a handgun to disengage the trigger guard from a catch associated with the outer side of the holster with no displacement, with only a small displacement of the part of the inner side of the holster facing the catch, or could permit the entire inner side of the holster body to be displaced a small distance, or could permit a slight actual separation or moving apart of the inner and outer sides of the holster when a security strap is disengaged to prepare the holster for withdrawal of the handgun. The internal dimensions of such a holster would be reduced for retention and carrying of a handgun with maximum security by fastening the security strap, but the catch associated with the outer side would provide secure retention of a handgun as in the holster 10 when the security strap is disengaged.

Referring next to FIGS. 17–23, a holster 170 which is a further embodiment of the invention is of somewhat similar construction to the holster 10. The holster 170 includes a catch 172 formed integrally with a connecting portion 174, which is similar to the connecting portion 132 in that it includes a welt or spacer portion 176 between the outer side 178 and inner side 180 of the handgun-receiving pocket 182 of the holster 170. The catch 172 includes an obliquely inclined upper cam surface 184 facing upward and toward the inner side 180 of the handgun-receiving pocket 182 and extending to the end 186 of the catch 172, which is directed toward the inner side 180 of the holster 170. Front and rear surfaces 188 and 190 of the catch extend laterally of the holster, generally normal to the outer side 178, as does a downwardly convex cylindrical bottom surface 192 of the catch 172. As in the holster 10, the spacer portion 176 of the connecting portion 174 has an upper or inner surface 194, located beneath the catch 172, which defines a trigger guard position between the rear portions of the inner side 180 and outer side 178. This provides room for the trigger guard 30 beneath the catch 172, but prevents a handgun from being urged into the holster 170 so far that it could be discharged by pressure of the catch 172 itself against the trigger within the trigger guard 30.

Instead of relying exclusively on the resiliency of the compressible material forming the inner side and outer side of the handgun-receiving pocket 182 of the holster 170 to keep a trigger guard 30 of a handgun engaged with the catch 172, a movable guide plate 196 of stiff yet resilient sheet material is located within the handgun-receiving pocket 182 of the holster 170. A small portion of the laminated material forming the inner side 180 is cut away, forming an opening 198, to leave room for the guide plate 196 to be moved resiliently outward, away from the interior of the handgun-receiving pocket 182, as indicated by the arrow 200. This provides clearance for passage of the trigger guard 30 toward the wearer of the holster 170 far enough for the trigger guard 30 to clear the end of the catch 172. The guide plate 196 is preferably formed integrally as a part of a plate 202 lying between the connecting portion and the inner side 180 of the holster, and the movable guide plate 196 is preferably defined by a slot 204. An upper margin 206 of the guide plate 196 extends at an obtuse angle upwardly and outwardly, relative to the interior of the handgun-receiving pocket 182 of the holster, to a position within the opening 198 defined in the inner side 180, so that when a handgun is inserted into the holster 170 its trigger guard 30 will encounter the sloped upper margin 206 of the guide plate 196, as well as the sloped cam surface 184 of the catch 172. As the handgun is pushed downward the trigger guard 30 rides along the catch 172, and by camming action forces the guide plate 196 to bend resiliently away from the interior of the handgun-receiving pocket 182 of the holster, into the opening 198, until the trigger guard 30 passes the end 186 of the catch 172. Once the trigger guard 30 passes the end 186 of the catch 172 the guide plate 196, by its elastic restoring forces, urges the trigger guard 30 laterally toward the outer side 178 and under the catch 172, which then prevents the handgun from being removed from the holster.

For removal of a handgun from the holster, the same motion is necessary as has been described above in connection with the holster 10. That is, urging the butt end of the grip of the handgun inward, toward the wearer, thus rotating the handgun slightly toward the wearer about an axis 122 generally parallel with the bore of the barrel of the handgun, brings the trigger guard 30 into contact with the guide plate 196 and forces the guide plate away from the end 186 until clearance is available for the trigger guard 30 to be moved past the end 186, allowing the handgun then to be withdrawn upward from the handgun-receiving pocket 182, in a direction parallel with the axis of the bore of the barrel.

A space 208 is provided outside the handgun-receiving pocket 182 for movement of the guide plate 196 laterally away from the catch 172 toward the holster wearer, by a spacer 210 which is preferably formed integrally with a backing plate 212 to which the belt loop is attached. The integral construction of the backing plate 212 and the spacer 210 also permits countersinking the ends of rivets 214 which fasten the rear margins of the frame 216 to the laminated material forming the handgun-receiving pocket. The backing plate 212 may be made, for example, of a rigid plastic such as nylon, ABS or polystyrene.

The outer surface of the backing plate 212 preferably is covered with loop pile material 218 of a hook-and-loop fastener system. A thumb break strap 220 is attached to the backing plate 212 by mating hook-bearing fastener material 222, attached to the thumb break strap 220, with the loop pile material 218 located on the outer surface of the backing plate 212.

A forward margin 224 of the backing plate 212 is slightly thicker than the central portion of the backing plate, to provide desired additional rigidity to support the frame 216. A rearward margin 226 of the upper portion of the inner side of the frame 216 is attached to the forward margin 224 of the backing plate 212, preferably by rivets 228. At the lower end of the holster 170 the frame 216 continues rearward along the inner side 180 of the handgun-receiving pocket 182 of the holster, in position to receive the nut for a clamp bolt 230. The clamp bolt 230 functions in the same manner as the clamp bolt 80 in the holster 10 described above, to squeeze the lower, or clamping, band portion of the frame 216 inward against the compressible laminated material forming the inner side 180 and outer side 178 of the handgun-receiving pocket 182.

Preferably, a ribbon-like spine strip 232 of tough, flexible, somewhat slippery material such as sheet polyurethane is sewn to the top and bottom margins of the handgun-receiving pocket of the holster, and extends vertically along the interior of the front portion. This guards the fabric of the interior layer of the handgun-receiving pocket against being torn by the sight of a handgun, and protects the sight blade of a handgun against abrasion during drawing or replacement of a handgun within the pocket.

A safety strap 234 of a flexible moldable plastic material such as a polyurethane, TPO or TPE is sewn to the upper margin of the outer side of the handgun-receiving pocket, in position to wrap around the upper portion of a handgun within the holster and to be fastened to the thumb break by mating snap fasteners 236.

Figure 24:
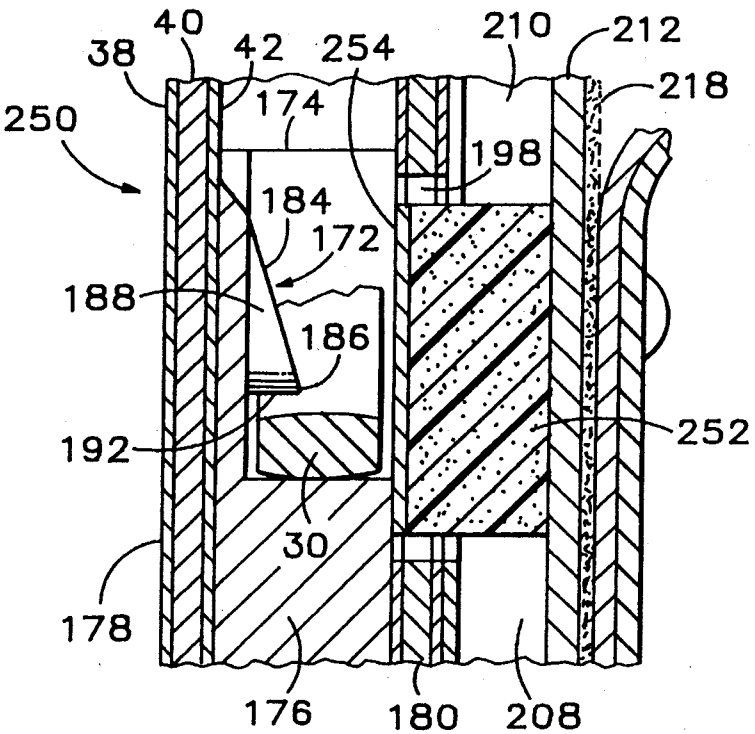
FIG. 24 is a view similar to that of FIG. 22, but showing a compressible guide body in place of the guide plate shown in FIGS. 23 and 24.
Figure 23:
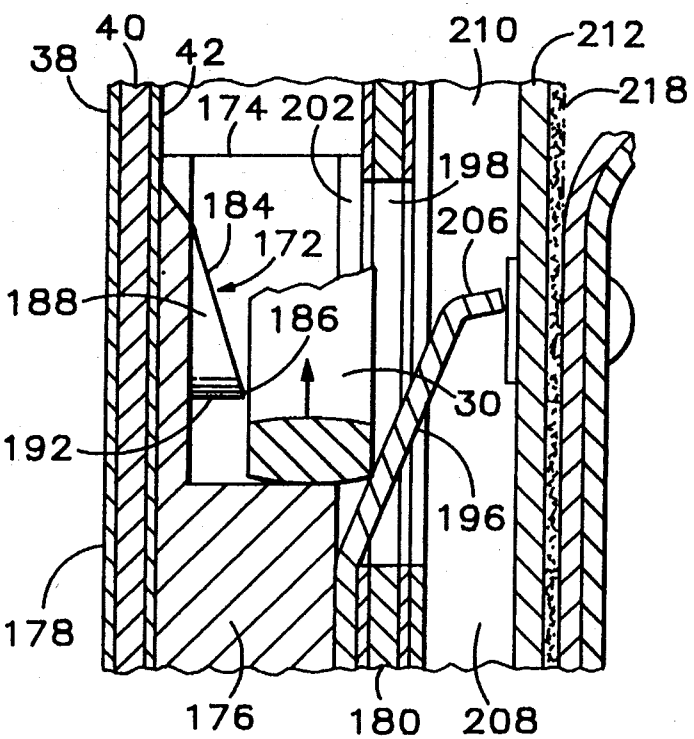
FIG. 23 is a view similar to that of FIG. 22, showing a movable portion of the guide plate displaced to permit removal of a handgun from the holster.

As shown in FIG. 24, in a further embodiment of the invention a holster 250 is similar to the holster 170 shown in FIGS. 17–23, except that instead of the guide plate 196 of the holster 170, a resiliently compressible guide body 252 is located opposite the catch 172. A material such as a compressible open-cell synthetic foam, is suitable for the guide body 252. The guide body 252 is attached to the backing plate 212 by an adhesive and extends through the opening 198 defined in the laminated material of the inner side 180 of the handgun-receiving pocket 182. A layer 254 of suitably tough material such as a wear-resistant cloth is attached adhesively to the foam to provide a suitably low coefficient of friction for the trigger guard, and to protect the foam material from being torn away by the trigger guard.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A handgun holster for securely holding a handgun including a trigger guard, the holster comprising:

(a) a holster body having a front portion and including an outer side and an inner side each having a respective rear portion said rear portions opposite said front portion and adapted to be adjacent said trigger guard when a handgun is held in said holster;

(b) spacer means for spacing apart said rear portions and defining a trigger guard position above said spacer means and between said rear portions;

(c) a catch located in a fixed position and stationary with respect to said outer side and having an end projecting toward said inner side within said trigger guard position and proximate said spacer means, said catch also having a rear surface facing rearwardly away from said front portion of said holster body, and a bottom surface, each of said rear and bottom surfaces being oriented transversely of said holster and substantially normal to said rear portion of said outer side;

(d) a movable guide associated with said inner side, located opposite said catch and alongside a trigger guard path between said catch and said rear portion of said inner side, said movable guide normally being located in a first position closer to said end of said catch and obstructing said trigger guard path, so as to prevent a trigger guard from moving past said end of said catch while said movable guide is located in said first position, and being movable to a second position spaced further from said end of said catch, in which said guide does not obstruct said trigger guard path; and (e) resilient means for urging said movable guide toward said first position.

2. The holster of claim 1 wherein said movable guide includes a resiliently compressible guide body.

3. The holster of claim 2 wherein said inner side defines an opening and said resiliently compressible guide body extends through said opening.

4. The holster of claim 1, including a backing plate spaced apart from said inner side, said inner side defining an opening, and said movable guide including a resiliently compressible guide body attached to said backing plate and extending through said opening toward said catch.

5. The holster of claim 1 wherein said movable guide is a guide plate of stiff yet resiliently flexible material located adjacent said inner side.

6. The holster of claim 5 wherein said inner side defines an opening, said guide plate being movable resiliently away from said catch into said opening.

7. In combination with a handgun having a trigger guard, the trigger guard having a radial thickness and a lateral width, a handgun holster for securely holding said handgun, the holster comprising:

(a) a holster body having a front portion and including an outer side having a rear portion and an inner side having a rear portion said rear portions being opposite said front portion and adapted to be adjacent said trigger guard when a handgun is held in said holster, said inner side having a normal position with respect to said outer side;

(b) connecting means for interconnecting said rear portions and partially defining an upwardly open pocket for receiving said handgun with said trigger guard located between said rear portions of said outer and inner sides; and (c) a catch located fixedly and stationary with respect to said outer side and having an end projecting toward said inner side to a position inside said trigger guard when said handgun is located in said pocket, said catch being located within said pocket and proximate said connecting means and having respective bottom and rear surfaces extending transversely of said holster and spaced apart from said connecting means by a distance at least equal to said radial thickness, said rear surface facing rearwardly away from said front portion of said holster body and toward said rear portions, a part of said inner side having a normal location spaced apart from said end of said catch a distance less than said lateral width and said part of said inner side being resiliently movable away from said end of said catch to provide clearance, between said end and said part of said inner side, at least as great as said lateral width, for passage of said trigger guard past said catch when said part of said inner side is moved away from said end of said catch, and said holster including means for continuously urging said part of said inner side toward said outer side.

8. The holster of claim 7, wherein said front portion interconnects said outer and inner sides, said holster further including an externally located frame of resiliently stiff sheet material extending around said front portion of said body and along said outer and inner sides, respective portions of said outer and inner sides being attached to said frame.

9. The holster of claim 8 wherein said catch is fastened to said frame and extends through said outer side into said pocket.

10. The holster of claim 8, further comprising spacer means for providing clearance between said frame and said inner side to enable said part of said inner side to be moved away from said end of said catch.

11. The holster of claim 8, further comprising a belt loop connected with said frame so as to support said holster.

12. The holster of claim 7 wherein said connecting means includes a welt holding said rear portions apart from each other by a distance at least equal to said lateral width of said trigger guard, said welt defining surface means for supporting said trigger guard when said handgun is located in said pocket and engaged by said catch.

13. The holster of claim 7 wherein said catch includes an upwardly facing cam surface oriented and located to engage said trigger guard and thus direct said trigger guard toward said inner side and around said end of said catch as said handgun is moved downwardly into said pocket.

14. The holster of claim 13 wherein said trigger guard has an inner surface, said bottom and rear surfaces of said catch extending substantially normal to said outer side and engaging said inner surface of said trigger guard and retaining said handgun in said pocket of said holster, until said handgun is manipulated to urge said trigger guard toward said inner side and thereby move said part of said inner side far enough away from said end of said catch to create clearance for said trigger guard between said inner side and said end of said catch.

15. The holster of claim 7 wherein said connecting means and said catch are an integral structure.

16. The holster of claim 7 wherein said body is of molded synthetic plastic sheet material.

17. The holster of claim 7 wherein said body is of leather.

18. The holster of claim 7 wherein at least said inner side of said body comprises a plurality of layers of flexible material overlying one another, at least one of said layers being resiliently compressible.

19. The holster of claim 7, wherein said part of said inner side includes a guide plate of stiff yet resiliently flexible material.

* * * * *

UNITED STATES PATENT AND TRADEMARK OFFICE

CERTIFICATE OF CORRECTION

PATENT NO. : 5,419,474

DATED : May 30, 1995

INVENTOR(S) : Thomas A. Marx et al.

It is certified that error appears in the above-identified patent and that said Letters Patent is hereby corrected as shown below:

Col. 12, line 19 After "rear portions" insert --being--.

Signed and Sealed this

Twenty-ninth Day of August, 1995

Bruce Lehman

*Attest:*

BRUCE LEHMAN

*Attesting Officer*

*Commissioner of Patents and Trademarks*